United States Patent [19]

Andress

[11] 4,394,135

[45] Jul. 19, 1983

[54] LIQUID HYDROCARBON FUEL COMPOSITION

[75] Inventor: Harry J. Andress, Wenonah, N.J.

[73] Assignee: Mobil Oil Corporation, New York, N.Y.

[21] Appl. No.: 156,969

[22] Filed: Jun. 6, 1980

Related U.S. Application Data

[63] Continuation-in-part of Ser. No. 945,280, Sep. 25, 1978, abandoned.

[51] Int. Cl.[3] ..... C10L 1/22

[52] U.S. Cl. ..... 44/71; 44/66

[58] Field of Search ..... 44/71, 66; 252/51.5 A, 252/34.7

[56] References Cited

U.S. PATENT DOCUMENTS

| | | | |
|---|---|---|---|
| 2,658,823 | 11/1953 | Andress, Jr. | 44/66 |
| 2,851,344 | 9/1958 | Marsh et al. | 44/71 |
| 3,894,849 | 7/1975 | Polss | 44/66 |
| 3,897,349 | 7/1975 | Marin et al. | 44/66 |
| 3,981,682 | 9/1976 | Ward et al. | 44/71 |
| 3,996,024 | 12/1976 | Coon | 44/71 |

*Primary Examiner*—Charles F. Warren
*Assistant Examiner*—Y. Harris-Smith
*Attorney, Agent, or Firm*—Charles A. Huggett; Michael G. Gilman; Claude E. Setliff

[57] ABSTRACT

A fuel composition comprising a liquid hydrocarbon fuel and a detergent amount of the product of reaction between a polyamine and a stearic acid is described.

3 Claims, No Drawings

LIQUID HYDROCARBON FUEL COMPOSITION

CROSS REFERENCE TO RELATED APPLICATIONS

This application is a continuation-in-part of copending application U.S. Ser. No. 945,280, filed Sept. 25, 1978, now abandoned.

BACKGROUND OF THE INVENTION

1. Field of the Invention

The invention relates to liquid hydrocarbon fuels stabilized against screen clogging and sediment formation.

2. Discussion of the Prior Art

As is well known to those familiar with the art, liquid hydrocarbon combustion fuels, such as fuel oils and gasolines, tend to exhibit certain deleterious characteristics, either after long periods of storage, or under the conditions of operational use. Thus, for example, fuel oils have been found to be unstable in high temperature environment and tend to foul heat-exchange tubes and to cause clogging of screens and plugging of tubes. Sediment formation is another factor often encountered. In gasolines, as well as in fuel oils, oxidation and the effect of metal activity are also undesirable phenomena that are sought to be eliminated. Accordingly, a means for stabilizing such fuels and protecting them against sediment formation and screen clogging activity is highly desirable.

Attempts to provide the desired protection have been made. Such attempts, as exemplified by the disclosure in U.S. Pat. No. 3,497,334 were highly successful as measured against the state of the prior art. The patent discloses a liquid hydrocarbon fuel composition containing a product made by reacting a succinic acid with a polyamine. It was an object of the present invention to provide fuel composition having improved detergency properties and that object has been accomplished by the invention hereinafter described.

SUMMARY OF THE INVENTION

In accordance with the invention, there is provided a liquid hydrocarbon fuel composition comprising fuel and, as the sole detergent, a detergency amount of the product of reaction between phenylstearic acid or isostearic acid and a polyamine of the formula $$NH_2—(C_nH_{2n}NH)_x—C_nH_{2n}—NH_2$$

wherein n is from 2 to 4 and x is 1 to 9.

DESCRIPTION OF SPECIFIC EMBODIMENTS

As has already been mentioned, phenylstearic or isostearic acids are used for reaction with the polyamine. Phenylstearic acid (or phenyloctadecanoic acid as it is also known) may be prepared by reacting 1 mole of oleic acid with an excess of benzene in the presence of a Friedel-Crafts type of catalyst at about 50° to 70° C. for several hours. The benzene is at the 9.10 position of the octadecanoic acid. Isostearic acid is a by-product of the reaction to form the dimer or trimer of linoleic acid and contains one or more $CH_3$ branches.

Commercial dimer acids are prepared by the acid-catalyzed polymerization of unsaturated $C_{18}$ acids. The exact structures have not been determined. Some of the $C_{18}$ acids undergo rearrangement reactions during the process to form monomer acids with methyl-branches and are known as isostearic acids.

The polyamine reactant employed with the specified acids, as indicated hereinabove, has the formula $$NH_2—(C_nH_{2n}NH)_x—C_2H_{2n}—NH_2$$

wherein x is 1 to 9 and n is 2 to 4. Illustrative of the amines are: diethylene, dipropylene or dibutylene triamine; triethylene, tripropylene or tributylene tetraamine; tetraethylene, tetrapropylene or tetrabutylene pentamine; pentaethylene, pentapropylene or pentabutylene hexamine; octaethylene, octapropylene or octabutylene nonamine; and decaethylene, decapropylene or decabutylene undecamine.

The polyamine reactant is employed in an amount to give a completely acylated product. That is, sufficient acid should be present in the reaction mixture to completely acylate the polyamine. For example, if x is 9 and 1 mole of the polyamine is employed, 11 moles of acid would be required for complete acylation. A small excess, approximately 5%, might be present to assure complete reaction with all the amine functions. The reaction temperature is within the range of from about 200° C. to about 300° C., preferably about 225° C. to about 275° C. The time of reaction is not critical, but will usually range from about 4 hours to about 8 hours.

A solvent may be used if desired. In general, any organic solvent may be used if the reactants are readily dispersible or soluble therein and if the solvent is readily removable from the product. Such solvents include toluene and xylene.

It should be noted that the structure of the product obtained from the acid-polyamine reaction is unknown. Due to the nature of the reactants, it likely has a very complex structure, ranging from simple amides to relatively high molecular weight polyamides. This justifies reference to the additives, both in the specification and in the claims, as reaction products.

The additive composition, i.e., the aforementioned reaction product, is added to the fuel in a small amount to attain the benefits of the invention. In general, the additive composition may vary from about 1 to about 200, and, preferably, from about 1 to about 25 pounds per thousand barrels of fuel; or, in corresponding terms of percent, by weight, the concentrations of additive compositions may vary from about 0.00025 to about 0.1, and, preferably, from about 0.00025 to about 0.01 percent, by weight, of the fuel.

The distillate fuel oils are characterized by their relatively low viscosities, pour points, and the like. The principal property which characterizes the contemplated hydrocarbons, however, is the distillation range. More specifically, this range will lie between about 100° F. and about 750° F. Obviously, the distillation range of each individual fuel oil will cover a narrower boiling range falling, nevertheless, within the above-specified limits. Likewise, each fuel oil will boil substantially continuously throughout its distillation range.

Particularly contemplated among the fuel oils are Nos. 1, 2 and 3 fuel oils used in heating and as diesel fuel oils, and the jet combustion fuels. The domestic fuel oils generally conform to the specifications set forth in ASTM Specifications D396-48T. Specifications for diesel fuels are defined in ASTM Specification D975-48T. Typical jet fuels are defined in Military Specification MIL-F-5624B.

The gasolines that are improved by the additive compositions of this invention, are mixtures of hydrocarbons having an initial boiling point falling betwen about 75° F. and about 135° F. and an end-boiling point falling between about 250° F. and about 450° F. As is well known to the art, motor gasoline can be straight run gasoline or, as is more usual, it can be a blend of two or more cuts or materials including straight run stock, catalytic or thermal reformate, cracked stock, alkylated natural gasoline, and aromatic hydrocarbons.

The following examples and comparative data are intended to illustrate the novel additive compositions of the present invention and to demonstrate their effectiveness in improving the properties of liquid hydrocarbon combustion fuels. It will be understood, of course, that it is not intended that the invention be limited to the particular compositions shown or the operations or manipulations involved. Various other additive compositions within the scope of the claims, and other fuels, can be utilized, as those skilled in the art will readily appreciate.

EXAMPLE 1

A mixture of 360 grams (1 mole) of phenylstearic acid and 40 grams (0.2 mole) of tetraethylene pentamine was stirred to about 250° C. over a 4-hour period and held at 250° for 30 minutes to form the reaction product.

EXAMPLE 2

A mixture of 852 grams (3.0 moles) of isostearic acid and 114 grams (0.6 mole) of tetraethylene pentamine was stirred to 275° C. over a 4-hour period, whereupon the reaction product was formed.

EXAMPLE 3

A mixture of 807 grams (2.85 moles) of a tall oil fatty acid mixture comprising about 52% oleic acid, 36% linoleic acid, 8% conjugated linoleic acid, and 4.0% rosin acids and 108 grams tetraethylene pentamine (0.57 mole) was stirred to about 275° C. over an eight-hour period to form the final product.

EVALUATION OF THE PRODUCTS

Carburetor Detergency Test

The additives were blended in a gasoline comprising 40% catalytically cracked component, 40% catalytically reformed component and 20% alkylate of approximately 90°–410° boiling range.

In the test, a 1973, six-cylinder, 240 cubic inch Ford truck engine with exhaust gas recirculation was operated for 24 hours on a cycle consisting of three-minute idle, 700 RPM, followed by a seven-minute cruise at 2000 RPM. A controlled amount of the engine's blowby gas was metered into the intake air to induce deposit formation. Deposit formation was determined by weighing the removable aluminum throttle sleeve before and after the test and also by visual rating thereof.

The results obtained are summarized in Table 1.

TABLE 1

| Component | Additive Conc., Lbs./1000 Bbls. | % Reduction in Deposits |
|---|---|---|
| Base Fuel | | 0 |
| Base Fuel + Ex. 1 | 30 | 95 |
| Base Fuel + Ex. 2 | 30 | 94 |
| Base Fuel + Ex. 3 | 30 | 95 |

I claim:

1. A liquid hydrocarbon fuel composition comprising fuel and, as the sole detergent, a detergency amount of the product of reaction between phenylstearic acid and a polyamine of the formula $$NH_2—(C_nH_{2n}NH)_x—C_nH_{2n}—NH_2$$

wherein n is from 2 to 4 and x is 1 to 9 and wherein the reactants and employed in proportions such that sufficient acid is present to completely acylate the said polyamine.

2. The composition of claim 1 wherein the polyamine is tetraethylene pentamine.

3. The composition of claim 1 wherein said detergency amount is from about 0.00025% to about 0.1% by weight.

* * * * *